US010620570B2

(12) United States Patent
Tzomik et al.

(10) Patent No.: US 10,620,570 B2
(45) Date of Patent: Apr. 14, 2020

(54) HEAT TRANSFER PRINTING

(71) Applicant: HP Indigo B.V., Amstelveen (NL)

(72) Inventors: Inna Tzomik, Nes Ziona (IL); Albert Teishev, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/475,797

(22) PCT Filed: Apr. 5, 2017

(86) PCT No.: PCT/EP2017/058086
§ 371 (c)(1),
(2) Date: Jul. 3, 2019

(87) PCT Pub. No.: WO2018/184670
PCT Pub. Date: Oct. 11, 2018

(65) Prior Publication Data

US 2019/0354042 A1 Nov. 21, 2019

(51) Int. Cl.
*G03G 15/16* (2006.01)

(52) U.S. Cl.
CPC ..... *G03G 15/161* (2013.01)

(58) Field of Classification Search
CPC ... B44C 1/1712; B41M 3/12; B41M 2205/10; G03G 15/161
See application file for complete search history.

(56) References Cited

U.S. PATENT DOCUMENTS 6,165,669 A * 12/2000 Zhao ..... G03G 13/16 399/296
6,309,786 B1 * 10/2001 Zhao ..... G03G 13/16 430/125.31
6,369,843 B1 4/2002 Springett et al.
6,869,650 B2 3/2005 Burch et al.
(Continued)

FOREIGN PATENT DOCUMENTS

JP 9146336 6/1997
WO 2011017388 2/2011
(Continued)

OTHER PUBLICATIONS

International Search Report dated Dec. 7, 2017 for PCT/EP2017/058086, Applicant HP Indigo B.V.

*Primary Examiner* — Sevan A Aydin
(74) *Attorney, Agent, or Firm* — HP Inc. Patent Department

(57) ABSTRACT

There is provided a process for heat transfer printing, comprising: electrostatically printing a transparent release composition onto a transfer material (1) to form a release layer (2) disposed on the transfer material; (1) electrostatically printing an electrostatic ink composition to form an image layer (3) disposed on the release layer (2); applying a heat-activatable adhesive composition to the image layer to form a heat-activatable adhesive layer (4); contacting the heat-activatable adhesive layer (4) with a target substrate (5) under conditions such that the heat-activatable adhesive layer (4) is activated to adhere to the target substrate and the release layer (2) is softened; and separating the target substrate (5) and the transfer material (1) such that the heat-activatable layer (4), image layer (3) and release layer (2) are transferred to the target substrate.

15 Claims, 1 Drawing Sheet

(56) References Cited

U.S. PATENT DOCUMENTS

| | | | | |
|---|---|---|---|---|
| 8,450,242 | B2 | 5/2013 | Majumdar et al. | |
| 2003/0165753 | A1 | 9/2003 | Suzuki et al. | |
| 2006/0216482 | A1 | 9/2006 | Sugita | |
| 2012/0062671 | A1* | 3/2012 | Liu | B41F 16/0046 347/103 |
| 2016/0130460 | A1 | 5/2016 | Ron et al. | |
| 2016/0335927 | A1 | 11/2016 | Lux et al. | |
| 2019/0030420 | A1* | 1/2019 | Tzomik | B42D 15/025 |
| 2019/0121279 | A1* | 4/2019 | Tzomik | B44C 1/1712 |

FOREIGN PATENT DOCUMENTS

| | | |
|---|---|---|
| WO | 2014206492 | 12/2014 |
| WO | 2015112141 | 7/2015 |
| WO | 2015148685 | 10/2015 |
| WO | 2016206724 | 12/2016 |
| WO | 2017067606 | 4/2017 |

* cited by examiner

HEAT TRANSFER PRINTING

BACKGROUND

Heat transfer printing (also known as thermal transfer printing) is the process of transferring images from one substrate to another by the application of heat. The image may first be applied to a first substrate, for example, a polymeric film, this image then brought into contact with a target substrate, e.g. a metallic film, glass or fabric, and heated. The target substrate and the first substrate may then be separated, leaving the image (in reverse) on the target substrate.

DETAILED DESCRIPTION

Figure 1A:
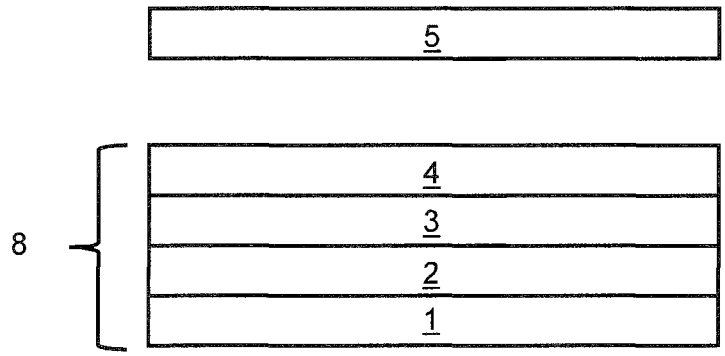
FIGS. 1A, 1B and 1C show, schematically, an example of a process for heat transfer printing, as disclosed herein.

Before the heat transfer printing and related aspects are disclosed and described, it is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited by the appended claims and equivalents thereof.

It is noted that, as used in this specification and the appended claims, the singular forms "a," "an," and "the" include plural referents unless the context clearly dictates otherwise.

As used herein, "liquid carrier", "carrier liquid," "carrier," or "carrier vehicle" refers to the fluid in which the polymers, particles, colorant, charge directors and other additives can be dispersed to form a liquid electrostatic composition or electrophotographic composition. Such carrier liquids and vehicle components are known in the art. Typical carrier liquids can include a mixture of a variety of different agents, such as surfactants, co-solvents, viscosity modifiers, and/or other possible ingredients.

As used herein, "electrostatic ink composition" generally refers to an ink composition that is typically suitable for use in an electrostatic printing process, sometimes termed an electrophotographic printing process. The electrostatic ink composition, when printing, may include chargeable particles of the resin and, if present, the pigment dispersed in a liquid carrier, which may be as described herein. The transparent release composition referred to herein may also be described as a transparent electrostatic ink composition, this may be an electrostatic ink composition that lacks a colorant (e.g. a pigment). An electrostatic ink composition for forming an image layer, in contrast, may contain a colorant. A colorant may be a species that imparts a colour to the ink, e.g. a colour selected from a magenta, cyan, yellow and black.

As used herein, "copolymer" refers to a polymer that is polymerized from at least two monomers.

A certain monomer may be described herein as constituting a certain weight percentage of a polymer. This indicates that the repeating units formed from the said monomer in the polymer constitute said weight percentage of the polymer.

Softening temperatures/softening points referred to herein may be measured according to standard techniques. For example, the softening point/temperature may be the Vicat softening point/temperature as measured according to ASTM D152, or the Ring and Ball softening point/temperature as determined according to ASTM E28-99.

If a standard test is mentioned herein, unless otherwise stated, the version of the test to be referred to is the most recent at the time of filing this patent application.

As used herein, "electrostatic printing" or "electrophotographic printing" generally refers to the process that provides an image that is transferred from a photo imaging substrate either directly, or indirectly via an intermediate transfer member, to a print substrate. As such, the image is not substantially absorbed into the photo imaging substrate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid composition is employed in the electrophotographic process rather than a powder toner. An electrostatic printing process may involve subjecting the electrostatic composition to an electric field, e.g. an electric field having a field gradient of 1000 V/cm or more, or in some examples 1500 V/cm or more.

As used herein, in the context of the electrostatic ink composition or the release composition, the term "transparent" may means having no or substantially no colorant or pigment.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

Unless otherwise stated, any feature described herein can be combined with any aspect or any other feature described herein.

In an aspect, there is provided a process for heat transfer printing. The process may comprise:

electrostatically printing a transparent release composition onto a transfer material to form a release layer disposed on the transfer material;

electrostatically printing an electrostatic ink composition to form an image layer disposed on the release layer;

applying a heat-activatable adhesive composition to the image layer to form a heat-activatable adhesive layer;

contacting the heat-activatable adhesive layer with a target substrate under conditions such that the heat-activatable adhesive layer is activated to adhere to the target substrate and the release layer is softened; and separating the target substrate and the transfer material such that the heat-activatable layer, image layer and release layer are transferred to the target substrate.

In an aspect, there is provided a heat transferable printed image comprising:

a transfer material;

an electrostatically printed transparent release layer disposed on the transfer material;

an electrostatically printed image layer disposed on the release layer; and a heat-activatable adhesive layer disposed on the image layer.

In an aspect, there is provided a method of printing a heat transferable image, the method comprising:

electrostatically printing a transparent release composition onto a transfer material to form a release layer disposed on the transfer material;

electrostatically printing an electrostatic ink composition to form an image layer disposed on the release layer;

applying a heat-activatable adhesive composition to the image layer to form a heat-activatable adhesive layer.

Figure 1B:
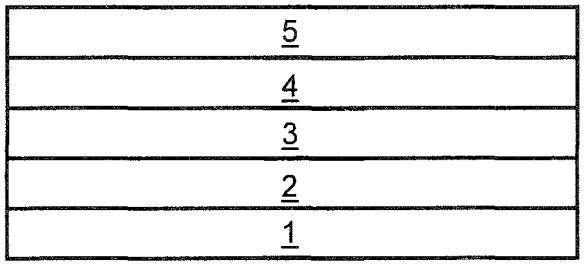
Figure 1C:
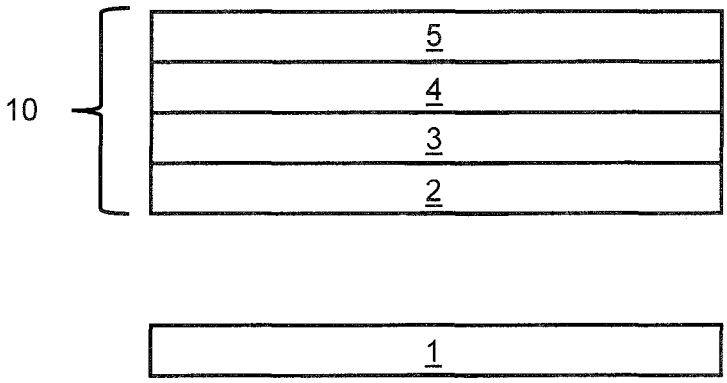

FIGS. 1A, 1B and 1C show, schematically, an example of a process for heat transfer printing, as disclosed herein. FIG. 1A shows a heat transferable printed image 8 comprising a transfer material 1 having a transparent release layer 2 disposed thereon, which, in turn, has printed thereon an image layer 3, which, in turn has applied thereon a heat-activatable adhesive layer 4. Both the transparent release composition forming the release layer 2 and the electrostatic ink composition forming the image layer 3 may have been printed by an electrostatic printing process. FIG. 1A also shows a target substrate 5, separated from the heat transferable printed image 8 comprising the transfer material 1, release layer 2, image layer 3 and heat-activatable adhesive layer 4.

In FIG. 1B, the target substrate 5 has been brought into contact with the heat-activatable adhesive layer 4 of the heat transferable printed image 8. Heat is applied to soften the release layer 2 and to activate the heat-activatable adhesive layer 4.

In FIG. 1C, the target substrate 5 and transfer material 1 have been separated, to provide a printed target substrate 5 comprising a the target substrate 5 having thereon the heat-activated adhesive layer 4, an image layer 3 disposed on the heat activated adhesive layer 4 and an overlying transparent release layer 2.

Transparent Release Composition

The transparent release composition may comprise a thermoplastic resin. In some examples, the transparent release composition comprises a thermoplastic resin and a solid polar compound. It may further comprise a charge adjuvant and/or a charge director. The transparent release composition does not contain any pigment, or substantially lacks pigment and thus is a pigment-free, or substantially pigment-free composition. The transparent release composition may otherwise be termed a transparent or colourless electrostatic ink composition or a colorless varnish for digital printing. The transparent release composition may comprise less than 5 wt % solids of colorant, in some examples less than 3 wt % solids of colorant, in some examples less than 1 wt % solids of colorant, in some examples less than 0.5 wt % of colorant, in some examples less than 0.1 wt % colorant. A "colorant" may be a material that imparts a color to the composition. As used herein, "colorant" includes pigments and dyes, such as those that impart colors such as black, magenta, cyan and yellow to an ink. As used herein, "pigment" generally includes pigment colorants, magnetic particles, aluminas, silicas, and/or other ceramics or organo-metallics. Thus, though the present description primarily exemplifies the use of pigment colorants, the term "pigment" can be used more generally to describe not only pigment colorants, but other pigments such as organometallics, ferrites, ceramics, etc.

The thermoplastic resin may constitute at least 85 wt % of the solids of the transparent release composition, in some examples at least 90 wt % solids of the solids of the transparent release composition, in some examples 95, wt % of the solids of the transparent release composition.

If a solid polar compound is present, the thermoplastic resin and the solid polar compound together may constitute at least 85 wt % of the solids of the transparent release composition, in some examples at least 90 wt % of the solids of the transparent release composition, in some examples 95, wt % of the solids of the transparent release composition.

The transparent release composition may further comprise one or more additives such as surfactants, viscosity modifiers, emulsifiers and the like.

In some examples, once printed, the transparent release composition forms a release layer of less than 10 μm in thickness, for example less than 9 μm in thickness, less than 8 μm in thickness, less than 7 μm in thickness, less than 6 μm in thickness, less than 5 μm in thickness, less than 4 μm in thickness, less than 3 μm in thickness, less than 2 μm in thickness, less than 1.5 μm in thickness. In some examples, the transparent release composition forms a release layer having a thickness of about 1 μm.

In some examples, once printed, the transparent release composition forms a release layer having a thickness of greater than 0.1 μm, for example greater than 0.2 μm, greater than 0.3 μm, greater than 0.4 μm, greater than 0.5 μm, greater than 0.6 μm, greater than 0.7 μm, greater than 0.8 μm, greater than 0.9 μm.

Liquid Carrier

In some examples, when printing, the transparent release composition comprises a liquid carrier. Generally, the liquid carrier can act as a dispersing medium for the other components in the transparent release composition. For example, the liquid carrier can comprise or be a hydrocarbon, silicone oil, vegetable oil, etc. The liquid carrier can include, but is not limited to, an insulating, non-polar, non-aqueous liquid that can be used as a medium for toner particles. The liquid carrier can include compounds that have a resistivity in excess of about $10^9$ ohm·cm. The liquid carrier may have a dielectric constant below about 5, in some examples below about 3. The liquid carrier can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Examples of the liquid carriers include, but are not limited to, aliphatic hydrocarbons, isoparaffinic compounds, paraffinic compounds, dearomatized hydrocarbon compounds, and the like. In particular, the liquid carriers can include, but are not limited to, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

Before electrostatic printing, the liquid carrier can constitute about 20% to 99.5% by weight of the transparent release composition, in some examples 50% to 99.5% by weight of the transparent release composition. Before printing, the liquid carrier may constitute about 40 to 90% by weight of the transparent release composition. Before printing, the liquid carrier may constitute about 60% to 80% by weight of the transparent release composition. Before printing, the liquid carrier may constitute about 90% to 99.5% by weight of the transparent release composition, in some examples 95% to 99% by weight of the transparent release composition.

The transparent release composition, when electrostatically printed on the transfer material as the release layer, may be substantially free from liquid carrier. In an electrostatic printing process and/or afterwards, the liquid carrier may be removed, e.g. by an electrophoresis processes during printing and/or evaporation, such that substantially just solids are transferred to the transfer material. Substantially free from liquid carrier may indicate that the release layer printed on the transfer material contains less than 5 wt % liquid carrier, in some examples, less than 2 wt % liquid carrier, in some examples less than 1 wt % liquid carrier, in some examples less than 0.5 wt % liquid carrier. In some examples, the release layer printed on the transfer material is free from liquid carrier.

Thermoplastic Resin

In some examples, the transparent release composition comprises a thermoplastic resin. In some examples, the transparent release composition comprises chargeable particles, i.e. having or capable of developing a charge, for example in an electromagnetic field, including the thermoplastic resin, in some example including the thermoplastic resin and the solid polar compound.

The thermoplastic resin may be any thermoplastic resin that is able to swell in a carrier liquid, for example a non-polar carrier liquid, as described herein. By swelling, it is meant that the resin is capable of increasing in size as a result of accumulation of the carrier liquid, e.g. non-polar carrier liquid. The swellable thermoplastic resin is also able to emit the carrier liquid when phase separation is initiated (e.g., when the swollen resin is exposed to heat at a temperature ranging from about 50° C. to about 80° C.). Examples of the swellable resin include ethylene acrylic acid copolymers and/or ethylene methacrylic acid copolymers. Both ethylene acrylic acid copolymers and ethylene methacrylic acid copolymers are commercially available under the tradename NUCREL® from E. I. du Pont de Nemours and Company, Wilmington, Del. The swelling of these types of resins may be due, at least in part, to the molecular structure similarity between the ethylene-based resin(s) and the non-polar carrier liquid. It is to be understood that any other homopolymer or copolymer that is capable of swelling in a non-polar carrier liquid and is also capable of releasing the non-polar carrier liquid when exposed to suitable heat conditions may also be used.

The thermoplastic resin may comprise a copolymer of an alkylene monomer and a monomer selected from acrylic acid and methacrylic acid. The thermoplastic resin may be referred to as a thermoplastic polymer. In some examples, the polymer may comprise one or more of ethylene or propylene acrylic acid co-polymers; ethylene or propylene methacrylic acid co-polymers; ethylene vinyl acetate co-polymers; co-polymers of ethylene or propylene (e.g. 80 wt % to 99.9 wt %), and alkyl (e.g. C1 to C5) ester of methacrylic or acrylic acid (e.g. 0.1 wt % to 20 wt %); co-polymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); co-polymers of ethylene or propylene (e.g. 70 wt % to 99.9 wt %) and maleic anhydride (e.g. 0.1 wt % to 30 wt %); polyethylene; polystyrene; isotactic polypropylene (crystalline); co-polymers of ethylene ethylene ethyl acrylate; polyesters; polyvinyl toluene; polyamides; styrene/butadiene co-polymers; epoxy resins; acrylic resins (e.g. co-polymer of acrylic or methacrylic acid and at least one alkyl ester of acrylic or methacrylic acid wherein alkyl may have from 1 to about 20 carbon atoms, such as methyl methacrylate (e.g. 50% to 90%)/methacrylic acid (e.g. 0 wt % to 20 wt %)/ethylhexylacrylate (e.g. 10 wt % to 50 wt %)); ethylene-acrylate terpolymers: ethylene-acrylic esters-maleic anhydride (MAH) or glycidyl methacrylate (GMA) terpolymers; ethylene-acrylic acid ionomers and combinations thereof.

The thermoplastic resin may comprise a polymer having acidic side groups. Examples of the polymer having acidic side groups will now be described. The polymer having acidic side groups may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures known in the art, for example using the procedure described in ASTM D1386.

The thermoplastic resin may comprise a polymer having acidic side groups, that has a melt flow rate of less than about 70 g/10 minutes, in some examples about 60 g/10 minutes or less, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers having acidic side groups and/or ester groups in the particles each individually have a melt flow rate of less than 90 g/10 minutes, 80 g/10 minutes or less, in some examples 80 g/10 minutes or less, in some examples 70 g/10 minutes or less, in some examples 70 g/10 minutes or less, in some examples 60 g/10 minutes or less.

The polymer having acidic side groups can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of, in some examples, about 50 g/10 minutes to about 120 g/10 minutes, in some examples 60 g/10 minutes to about 100 g/10 minutes. The melt flow rate can be measured using standard procedures known in the art, for example as described in ASTM D1238.

The acidic side groups may be in free acid form or may be in the form of an anion and associated with one or more counterions, typically metal counterions, e.g. a metal selected from the alkali metals, such as lithium, sodium and potassium, alkali earth metals, such as magnesium or calcium, and transition metals, such as zinc. The polymer having acidic sides groups can be selected from resins such as co-polymers of ethylene and an ethylenically unsaturated acid of either acrylic acid or methacrylic acid; and ionomers thereof, such as methacrylic acid and ethylene-acrylic or methacrylic acid co-polymers which are at least partially neutralized with metal ions (e.g. Zn, Na, Li) such as SURLYN® ionomers. The polymer comprising acidic side groups can be a co-polymer of ethylene and an ethylenically unsaturated acid of either acrylic or methacrylic acid, where the ethylenically unsaturated acid of either acrylic or methacrylic acid constitute from 5 wt % to about 25 wt % of the co-polymer, in some examples from 10 wt % to about 20 wt % of the co-polymer.

The thermoplastic resin may comprise two different polymers having acidic side groups. The two polymers having acidic side groups may have different acidities, which may fall within the ranges mentioned above. The resin may comprise a first polymer having acidic side groups that has an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has an acidity of 110 mg KOH/g to 130 mg KOH/g.

The thermoplastic resin may comprise two different polymers having acidic side groups: a first polymer having acidic side groups that has a melt flow rate of about 10 g/10 minutes to about 50 g/10 minutes and an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

The ratio of the first polymer having acidic side groups to the second polymer having acidic side groups can be from about 10:1 to about 2:1. The ratio can be from about 6:1 to about 3:1, in some examples about 4:1.

The thermoplastic resin may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described herein. The thermoplastic resin may comprise a first polymer having a melt viscosity of 15000 poise or more, in some examples 20000 poise or more, in some examples 50000 poise or more, in some examples 70000 poise or more; and in some examples, the thermoplastic resin may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The thermoplastic resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is Nucrel® 960 (from DuPont), and example of the second polymer is Nucrel® 699 (from DuPont), and an example of the third polymer is AC®-5120 or AC®-5180 (from Honeywell). The first, second and third polymers may be polymers having acidic side groups as described herein. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 Hz shear rate.

If the thermoplastic resin comprises a single type of polymer, the polymer (excluding any other components of the electrophotographic adhesive composition) may have a melt viscosity of 6000 poise or more, in some examples a melt viscosity of 8000 poise or more, in some examples a melt viscosity of 10000 poise or more, in some examples a melt viscosity of 12000 poise or more. If the thermoplastic resin comprises a plurality of polymers all the polymers of the resin may together form a mixture (excluding any other components of the electrophotographic adhesive composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 Hz shear rate.

The thermoplastic resin may comprise two different polymers having acidic side groups that are selected from co-polymers of ethylene and an ethylenically unsaturated acid of either acrylic acid or methacrylic acid; or ionomers thereof, such as methacrylic acid and ethylene-acrylic or methacrylic acid co-polymers which are at least partially neutralized with metal ions (e.g. Zn, Na, Li) such as SURLYN® ionomers. The resin may comprise (i) a first polymer that is a co-polymer of ethylene and an ethylenically unsaturated acid of either acrylic acid and methacrylic acid, wherein the ethylenically unsaturated acid of either acrylic or methacrylic acid constitutes from 8 wt % to about 16 wt % of the co-polymer, in some examples 10 wt % to 16 wt % of the co-polymer; and (ii) a second polymer that is a co-polymer of ethylene and an ethylenically unsaturated acid of either acrylic acid and methacrylic acid, wherein the ethylenically unsaturated acid of either acrylic or methacrylic acid constitutes from 12 wt % to about 30 wt % of the co-polymer, in some examples from 14 wt % to about 20 wt % of the co-polymer, in some examples from 16 wt % to about 20 wt % of the co-polymer in some examples from 17 wt % to 19 wt % of the co-polymer.

The thermoplastic resin may comprise a polymer having acidic side groups, as described above (which may be free of ester side groups), and a polymer having ester side groups. The polymer having ester side groups may be a thermoplastic polymer. The polymer having ester side groups may further comprise acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, but not limited to, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, in some examples 1 to 10 carbons; in some examples selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute 1% to 50% by weight of the co-polymer, in some examples 5% to 40% by weight, in some examples 5% to 20% by weight of the co-polymer, in some examples 5% to 15% by weight of the co-polymer. The second monomer may constitute 1% to 50% by weight of the co-polymer, in some examples 5% to 40% by weight of the co-polymer, in some examples 5% to 20% by weight of the co-polymer, in some examples 5% to 15% by weight of the co-polymer. The first monomer can constitute 5% to 40% by weight of the co-polymer, the second monomer constitutes 5% to 40% by weight of the co-polymer, and with the third monomer constituting the remaining weight of the co-polymer. In some examples, the first monomer constitutes 5% to 15% by weight of the co-polymer, the second monomer constitutes 5% to 15% by weight of the co-polymer, with the third monomer constituting the remaining weight of the co-polymer. In some examples, the first monomer constitutes 8% to 12% by weight of the co-polymer, the second monomer constitutes 8% to 12% by weight of the co-polymer, with the third monomer constituting the remaining weight of the co-polymer. In some examples, the first monomer constitutes about 10% by weight of the co-polymer, the second monomer constitutes about 10% by weight of the co-polymer, and with the third monomer constituting the remaining weight of the co-polymer. The polymer may be selected from the Bynel® class of monomer, including Bynel® 2022 and Bynel® 2002, which are available from DuPont®.

The polymer having ester side groups may constitute 1% or more by weight of the total amount of the thermoplastic resin, e.g. thermoplastic resin polymers, in the liquid electrophotographic adhesive composition and/or the adhesive composition printed on the print substrate, e.g. the total amount of the polymer or polymers having acidic side groups and polymer having ester side groups. The polymer having ester side groups may constitute 5% or more by weight of the total amount of the resin polymers, e.g. thermoplastic resin polymers, in some examples 8% or more by weight of the total amount of the resin polymers, e.g. thermoplastic resin polymers, in some examples 10% or more by weight of the total amount of the resin polymers, e.g. thermoplastic resin polymers, in some examples 15% or more by weight of the total amount of the resin polymers, e.g. thermoplastic resin polymers, in some examples 20% or more by weight of the total amount of the resin polymers, e.g. thermoplastic resin polymers, in some examples 25% or more by weight of the total amount of the resin polymers, e.g. thermoplastic resin polymers, in some examples 30% or more by weight of the total amount of the resin polymers, e.g. thermoplastic resin polymers, in some examples 35% or more by weight of the total amount of the resin polymers, e.g. thermoplastic resin polymers, in the liquid electrophotographic adhesive composition and/or the composition printed on the print substrate. The polymer having ester side groups may constitute from 5% to 50% by weight of the total amount of the resin polymers, e.g. thermoplastic resin polymers, in the liquid electrophotographic composition and/or the composition printed on the print substrate, in some examples 10% to 40% by weight of the total amount of the resin polymers, e.g. thermoplastic resin polymers, in the liquid electrophotographic composition and/or the composition printed on the print substrate, in some examples 5% to 30% by weight of the total amount of the resin polymers, e.g. thermoplastic resin polymers, in the liquid electrophotographic composition and/or the composition printed on the print substrate, in some examples 5% to 15% by weight of the total amount of the resin polymers, e.g. thermoplastic resin polymers, in the liquid electrophotographic composition and/or the composition printed on the print substrate in some examples 15% to 30% by weight of the total amount of the resin polymers, e.g. thermoplastic resin polymers, in the liquid electrophotographic composition and/or the composition printed on the print substrate.

The polymer having ester side groups may have an acidity of 50 mg KOH/g or more, in some examples an acidity of 60 mg KOH/g or more, in some examples an acidity of 70 mg KOH/g or more, in some examples an acidity of 80 mg KOH/g or more. The polymer having ester side groups may have an acidity of 100 mg KOH/g or less, in some examples 90 mg KOH/g or less. The polymer having ester side groups may have an acidity of 60 mg KOH/g to 90 mg KOH/g, in some examples 70 mg KOH/g to 80 mg KOH/g.

The polymer having ester side groups may have a melt flow rate of about 10 g/10 minutes to about 120 g/10 minutes, in some examples about 10 g/10 minutes to about 50 g/10 minutes, in some examples about 20 g/10 minutes to about 40 g/10 minutes, in some examples about 25 g/10 minutes to about 35 g/10 minutes.

The polymer, polymers, co-polymer or co-polymers of the resin can in some examples be selected from the Nucrel® family of toners (e.g. Nucrel 403™, Nucrel 407™, Nucrel 609HS™, Nucrel 908HS™, Nucrel 1202HC™, Nucrel 30707™, Nucrel 1214™, Nucrel 903™, Nucrel 3990™, Nucrel 910™, Nucrel 925™, Nucrel 699™, Nucrel 599™, Nucrel 960™, Nucrel RX 76™, Nucrel 2806™, Bynell 2002™, Bynell 2014™, Bynell 2020™ and Bynell 2022™, (sold by E.I. du PONT™)), the AC® family of toners (e.g. AC-5120™, AC-5180™, AC-540™, AC-580™ (sold by Honeywell™)), the Aclyn™ family of toners (e.g. Aclyn 201™, Aclyn 246™, Aclyn 285™, and Aclyn 295™), and the Lotader™ family of toners (e.g. Lotader 2210™, Lotader, 3430™ and Lotader 8200™ (sold by Arkema™)).

The thermoplastic resin of the transparent release composition or release layer may be softened to allow transfer of the heat transferable image from the transfer material to a target substrate.

In some examples, the thermoplastic resin may have a softening point (e.g. Vicat softening point as measured according to ASTM D1525 or the Ring and Ball softening point as determined according to ASTM E28-99) of about 30° C. or greater, for example about 40° C. or greater, about 50° C. or greater, or about 60° C. or greater.

In some examples, the thermoplastic resin may have a softening point (e.g. Vicat softening point as measured according to ASTM D1525 or the Ring and Ball softening point as determined according to ASTM E28-99) of up to about 150° C., for example up to about 130° C., up to about 120° C., up to about 110° C., or up to about 100° C.

In some examples, the thermoplastic resin may have a softening point (e.g. Vicat softening point as measured according to ASTM D1525 or the Ring and Ball softening point as determined according to ASTM E28-99) in the range of about 60° C. to about 150° C., for example about 60° C. to about 110° C.

Charge Director and Charge Adjuvant

In some examples, the transparent release composition includes either a charge director or a charge adjuvant or both.

In some examples, the transparent release composition includes a charge director. The charge director may be added to a transparent release composition in order to impart and/or maintain sufficient electrostatic charge on the particles of the composition. In some examples, the charge director may comprise ionic compounds, particularly metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director can be selected from, but is not limited to, oil-soluble petroleum sulfonates (e.g. neutral Calcium Petronate™, neutral Barium Petronate™, and basic Barium Petronate™), polybutylene succinimides (e.g. OLOA™ 1200 and Amoco 575), and glyceride salts (e.g. sodium salts of phosphated mono- and diglycerides with unsaturated and saturated acid substituents), sulfonic acid salts including, but not limited to, barium, sodium, calcium, and aluminum salts of sulfonic acid. The sulfonic acids may include, but are not limited to, alkyl sulfonic acids, aryl sulfonic acids, and sulfonic acids of alkyl succinates. The charge director can impart a negative charge or a positive charge on the resin-containing particles of a transparent release composition.

The charge director may be added in order to impart and/or maintain sufficient electrostatic charge on particles of the transparent release composition, which may be particles comprising the thermoplastic resin and/or a solid polar compound.

In some examples, the transparent release composition comprises a charge director comprising a simple salt. The ions constructing the simple salts are all hydrophilic. The simple salt may include a cation selected from the group consisting of Mg, Ca, Ba, $NH_4$, tert-butyl ammonium, $Li^+$, and $Al^{+3}$, or from any sub-group thereof. The simple salt may include an anion selected from the group consisting of $SO_4^{2-}$, $PO^{3-}$, $NO^{3-}$, $HPO_4^{2-}$, $CO_3^{2-}$, acetate, trifluoroacetate (TFA), $Cl^-$, $BF_4^-$, $F^-$, $ClO_4^-$, and $TiO_3^{4-}$ or from any sub-group thereof. The simple salt may be selected from $CaCO_3$, $Ba_2TiO_3$, $Al_2(SO_4)$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof.

In some examples, the transparent release composition comprises a charge director comprising a sulfosuccinate salt of the general formula $MA_n$, wherein M is a metal, n is the valence of M, and A is an ion of the general formula (I): $[R^1—O—C(O)CH_2CH(SO_3^-)C(O)—O—R^2]$, wherein each of $R^1$ and $R^2$ is an alkyl group. In some examples each of $R_1$ and $R_2$ is an aliphatic alkyl group. In some examples, each of $R_1$ and $R_2$ independently is a C6-25 alkyl. In some examples, said aliphatic alkyl group is linear. In some examples, said aliphatic alkyl group is branched. In some examples, said aliphatic alkyl group includes a linear chain of more than 6 carbon atoms. In some examples, $R_1$ and $R_2$ are the same. In some examples, at least one of $R_1$ and $R_2$ is $C_{13}H_{27}$. In some examples, M is Na, K, Cs, Ca, or Ba.

In some examples, the charge director comprises at least one micelle forming salt and nanoparticles of a simple salt as described above. The simple salts are salts that do not form micelles by themselves, although they may form a core for micelles with a micelle forming salt. The sulfosuccinate salt of the general formula $MA_n$ is an example of a micelle forming salt. The charge director may be substantially free of an acid of the general formula HA, where A is as described above. The charge director may include micelles of said sulfosuccinate salt enclosing at least some of the nanoparticles of the simple salt. The charge director may include at least some nanoparticles of the simple salt having a size of 200 nm or less, and/or in some examples 2 nm or more.

In some examples, the charge director constitutes about 0.001% to 20%, in some examples 0.01% to 20% by weight, in some examples 0.01 to 10% by weight, in some examples 0.01% to 1% by weight of the solids of a transparent release composition. In some examples, the charge director constitutes about 0.01% to 0.5% by weight of the solids of the transparent release composition, in some examples 0.05% to 0.5% by weight of the solids of a transparent release composition, in some examples 0.1% to 2% by weight of the solids of the transparent release composition, in some examples 0.2% to 1.5% by weight of the solids of the transparent release composition in some examples 0.1% to 1% by weight of the solids of the transparent release composition, in some examples 0.1% to 0.3% by weight of the solids of the transparent release composition.

In some examples, the charge director is present in an amount of from 3 mg/g to 20 mg/g, in some examples from 3 mg/g to 15 mg/g, in some examples from 10 mg/g to 15 mg/g, in some examples from 5 mg/g to 10 mg/g (where mg/g indicates mg per gram of solids of the transparent release composition).

A charge adjuvant may promote charging of the particles when a charge director is present in the electrostatic composition during printing. The charge adjuvant can include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Zn salts of stearic acid, Cu salts of stearic acid, Pb salts of stearic acid, Fe salts of stearic acid, metal carboxylates (e.g., Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock copolymers of 2-ethylhexyl methacrylate-co-methacrylic acid calcium and ammonium salts, copolymers of an alkyl acrylamidoglycolate alkyl ether (e.g., methyl acrylamidoglycolate methyl ether-co-vinyl acetate), and hydroxy bis(3,5-di-tert-butyl salicylic) aluminate monohydrate. In an example, the charge adjuvant is or includes aluminum di- or tristearate. The charge adjuvant may be present in an amount of about 0.1 to 5% by weight, in some examples about 0.1 to 1% by weight, in some examples about 0.3 to 0.8% by weight of the solids of the transparent release composition, in some examples about 1 wt % to 3 wt % of the solids of the transparent release composition, in some examples about 1.5 wt % to 2.5 wt % of the solids of the transparent release composition.

In some examples, the transparent release composition further includes, e.g. as a charge adjuvant, a salt of multivalent cation and a fatty acid anion. The salt of multivalent cation and a fatty acid anion can act as a charge adjuvant. The multivalent cation may, in some examples, be a divalent or a trivalent cation. In some examples, the multivalent cation is selected from Group 2, transition metals and Group 3 and Group 4 in the Periodic Table. In some examples, the multivalent cation includes a metal selected from Ca, Sc, Ti, V, Cr, Mn, Fe, Co, Ni, Cu, Zn, Al and Pb. In some examples, the multivalent cation is Al3+. The fatty acid anion may be selected from a saturated or unsaturated fatty acid anion. The fatty acid anion may be selected from a $C_8$ to $C_{28}$ fatty acid anion, in some examples a $C_{14}$ to $C_{22}$ fatty acid anion, in some examples a $C_{16}$ to $C_{20}$ fatty acid anion, in some examples a $C_{17}$, $C_{18}$ or $C_{19}$ fatty acid anion. In some examples, the fatty acid anion is selected from a caprylic acid anion, capric acid anion, lauric acid anion, myristic acid anion, palmitic acid anion, stearic acid anion, arachidic acid anion, behenic acid anion and cerotic acid anion.

The charge adjuvant, which may, for example, be or include a salt of multivalent cation and a fatty acid anion, may be present in an amount of 0.1 wt % to 5 wt % of the solids of the transparent release composition, in some examples in an amount of 0.1 wt % to 2 wt % of the solids of the transparent release composition, in some examples in an amount of 0.1 wt % to 2 wt % of the solids of the transparent release composition, in some examples in an amount of 0.3 wt % to 1.5 wt % of the solids of the transparent release composition, in some examples about 0.5 wt % to 1.2 wt % of the solids of the transparent release composition, in some examples about 0.8 wt % to 1 wt % of the solids of the transparent release composition, in some examples about 1 wt % to 3 wt % of the solids of the transparent release composition, in some examples about 1.5 wt % to 2.5 wt % of the solids of the transparent release composition.

Solid Polar Compound

The transparent release composition may further comprise a solid polar compound. The solid polar compound contains polar atoms, such as oxygen, nitrogen, etc., that prevent the solid compounds from dissolving or even swelling in a non-polar carrier liquid. As such, the solid polar compounds do not interact with the non-polar carrier liquid, but rather are dispersed in the thermoplastic resin. In some examples, the solid polar compound is a solid (e.g., at room temperature, i.e., from about 20° C. to about 25° C.), colorless organic material. The solid organic material may be a polymeric material or a non-polymeric material. The solid polar compound may be an organic particle that is resistant to swelling or dissolving in a non-polar carrier fluid, e.g. an isoparaffinic fluid as described herein. The solid polar compound may be dispersed in the thermoplastic resin, and, in some examples, is present in an amount up to 60 wt. % of solids in the transparent release composition. The solid polar compound may be selected from the group consisting of a saccharide, polyacrylic acid, polyvinyl alcohol, styrene maleic anhydride, a bismaleimide oligomer, a cellulose derivative and an aliphatic urethane acrylate.

In some examples, the transparent release composition comprises a saccharide. In some examples, the saccharide may be a modified saccharide. In some examples, modified saccharides are acetylated saccharides. In some examples, the transparent release composition comprises a disaccharide, e.g. a modified disaccharide. In some examples, the transparent release composition comprises a saccharide, e.g. a modified saccharide. In some examples, the saccharide may be selected from maltose, maltose monohydrate, sucrose, sucrose octanoate, sucrose octaacetate, dextrin, xylitol and sucrose benzoate.

In some examples, the transparent release composition comprises a saccharide in an amount of greater than 15 wt % of the non-volatile solids in the transparent release composition, for example, in an amount of greater than 20 wt % of the non-volatile solids in the transparent release composition, for example in an amount of greater than 25 wt % of the non-volatile solids in the transparent release composition, for example in an amount of greater than 30 wt % of the non-volatile solids in the transparent release composition. In some examples, the transparent release composition comprises a saccharide in an amount of less than 60 wt % of the non-volatile solids in the transparent release composition, for example less than 50 wt % of the non-volatile solids in the transparent release composition, for example less than 45 wt % of the non-volatile solids in the transparent release composition, for example less than 40 wt % of the non-volatile solids in the transparent release composition.

In some examples, the solid polar compound has a particle size from about 30 nm to about 300 nm, for example from about 50 nm to about 150 nm, or from about 70 nm to about 130 nm. The particle size of the solid polar compound may be the average particle size as determined by SEM, for example the average particle size of 100 particles as determined using SEM. In some examples, the particle size may be the average particle size determined using a Malvern particle size analyser.

Examples of commercially available styrene maleic anhydrides include copolymers from Sartomer Co. USA, LLC, such as SMA® 4000I, SMA® 1000I, and SMA® 1000P.

Examples of cellulose derivatives include sodium carboxylmethyl cellulose and cellulose acetate propionate. A suitable example of a bismaleimide oligomer is bis-stearamide, and a suitable example of an aliphatic urethane acrylate is REAFREE® UV ND-2335 from Arkema, Spain.

It is to be understood that these solid polar compounds are examples, and that any other organic material that includes polar atoms and is resistant to swelling or dissolving in a non-polar carrier fluid may be used.

Other Additives

The transparent release composition may include an additive or a plurality of additives. The additive or plurality of additives may be added at any stage of the method. The additive or plurality of additives may be selected from a wax, a surfactant, biocides, organic solvents, viscosity modifiers, materials for pH adjustment, sequestering agents, preservatives, compatibility additives, emulsifiers and the like. The wax may be an incompatible wax. As used herein, "incompatible wax" may refer to a wax that is incompatible with the resin. Specifically, the wax phase separates from the resin phase upon the cooling of the resin fused mixture on a print substrate during and after the transfer of the release film to the print substrate, e.g. from an intermediate transfer member, which may be a heated blanket.

Target Substrate

The target substrate may be any suitable medium. The target substrate may be any suitable medium capable of having an image printed thereon. The target substrate may include a material selected from an organic or inorganic material. The material may include a natural polymeric material, e.g. cellulose. The material may include a synthetic polymeric material, e.g. a polymer formed from alkylene monomers, including, but not limited to, polyethylene and polypropylene, and co-polymers such as styrene-polybutadiene. The polypropylene may, in some examples, be biaxially orientated polypropylene. The material may include a metal, which may be in sheet form. The metal may be selected from or made from, for instance, aluminium (Al), silver (Ag), tin (Sn), copper (Cu), mixtures thereof. The metal may be an elemental metal or a metal in alloy form. The material may comprise wood or glass and may be in sheet form. In an example, the print medium includes a cellulosic paper. In an example, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The target substrate is, in some examples, a cellulosic print medium such as paper. The cellulosic print medium is, in some examples, a coated cellulosic print.

In some examples, the target substrate comprises a film or sheet of at least one of paper, metallic foil, and plastic. In some examples, the target substrate is transparent. In some examples, the target substrate comprises a metallized paper or a metallized plastic film. In some examples, the target substrate comprises an aluminium foil. In some examples the target substrate comprises a film of a plastic material, for example, polyethylene (PE), linear low density polyethylene (LLDPE), low density polyethylene (LDPE), polypropylene (PP), biaxially oriented polypropylene (BOPP). In some examples, the target substrate comprises a metallized paper in the form of a paper substrate coated on one surface with a layer of metal, for example aluminium. In some examples, the target substrate comprises a metallized plastic film in the form of a polymer substrate coated on one surface with a layer of metal, for example aluminium. In some examples, the target substrate comprises a metallized plastic film in the form of a metallized BOPP film, a metallized PET film, or a metallized polyethylene (PE) film.

In some examples, the target substrate comprises a film of material, wherein the film is less than 100 μm in thickness, for example less than 90 μm in thickness, less than 80 μm in thickness, less than 70 μm in thickness, less than 60 μm in thickness, less than 50 μm in thickness, less than 40 μm in thickness, less than 30 μm in thickness, less than 20 μm in thickness, less than 15 μm in thickness. In some examples, the film of material is about 12 μm in thickness.

In some examples, the target substrate comprises a film of material, wherein the film is greater than 12 μm in thickness, for example greater than 15 μm in thickness, greater than 20 μm in thickness, greater than 30 μm in thickness, greater than 40 μm in thickness, greater than 50 μm in thickness, greater than 60 μm in thickness, greater than 70 μm in thickness, greater than 80 μm in thickness, greater than 90 μm in thickness. In some examples, the film of material is about 100 μm in thickness.

In some examples, the target substrate is a glass substrate, the glass substrate may have a thickness greater than 100 μm, for example the thickness of a glass substrate may be about 1 mm or greater.

In some examples, the target substrate comprises a fabric, for example a woven fabric, a knitted fabric or a non-woven fabric. A fabric may be a cloth made from yarn or fibres by weaving, knitting, felting or other techniques. In some examples, the target substrate comprises a fabric formed from yarns comprising material selected from polyester, polyamides, polyvinyl alcohols, lyocell, rayon, viscose, nylon, cotton, linen, flax, hemp, jute and wool, acetates, acrylic, elastane, silk or any combination thereof.

Transfer Material

The transfer material may be a material which conducts heat and on which the transparent release composition is electrostatically printed. The image layer is printed on the transfer material in reverse of how the image is to appear on the target substrate. The transfer material may also be referred to as the "label sheet" or the "ribbon". The transfer material may be a material that is different from the target substrate. For example, if the target substrate is or comprises a fabric, the transfer material may be a non-fabric material, e.g. a polymer film or a paper substrate.

The transfer material may be any suitable transfer medium for use in thermal transfer printing. The transfer material may be any suitable medium capable of having an image printed thereon, i.e. an image formed of the transparent release composition. In some examples, the transfer material comprises a material selected from a polyester film (such as a polyethylene terephthalate (PET) film), a polyvinyl chloride (PVC) film and a polyethylene film.

The transfer medium may comprises an amorphous (non-crystalline) polyester, such as amorphous polyethylene terephthalate (APET).

In some examples, the transfer material is to allow good thermal transfer. In some examples, the transfer material comprises a film of material, wherein the film is less than 100 μm in thickness, for example less than 90 μm in thickness, less than 80 μm in thickness, less than 70 μm in thickness, less than 60 μm in thickness, less than 50 μm in thickness, less than 40 μm in thickness, less than 30 μm in thickness, less than 20 μm in thickness, less than 15 μm in thickness. The transfer material may be in the form of a sheet or film and/or may have a thickness of from 5 μm to 250 μm, in some examples from 5 μm to 100 μm, in some examples from 5 μm to 50 μm, in some examples 5 to 20 μm or in some examples from 100 μm to 250 μm.

The transfer material may comprise a plurality of layers, e.g. a layer comprising a material selected from a polyester film (such as a polyethylene terephthalate (PET) film), a polyvinyl chloride (PVC) film and a polyethylene film, and a further layer, which may be a primer layer, onto which the transparent release composition is printed.

The transfer material may include a material selected from an organic or inorganic material. The material may include a natural polymeric material, e.g. cellulose. The material may include a synthetic polymeric material, e.g. a polymer formed from alkylene monomers, including, but not limited to, polyethylene and polypropylene, and co-polymers such as styrene-polybutadiene. The polypropylene may, in some examples, be biaxially orientated polypropylene. The material may include a metal, which may be in sheet form. The metal may be selected from or made from, for instance, aluminium (Al), silver (Ag), tin (Sn), copper (Cu), mixtures thereof. In an example, the print medium includes a cellulosic paper. In an example, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The transfer material is, in some examples, a cellulosic print medium such as paper. The cellulosic print medium is, in some examples, a coated cellulosic print.

In one example, the transfer material comprises a film or sheet of at least one of paper, metallic foil, and plastic. In one example, the transfer material is transparent. In one example, the transfer material comprises a metallized paper or a metallized plastic film. In one example, the transfer material comprises an aluminium foil. In one example the transfer material comprises a film of a plastic material, for example, polyethylene (PE), linear low density polyethylene (LLDPE), low density polyethylene (LDPE), polypropylene (PP), biaxially oriented polypropylene (BOPP). In one example, the transfer material comprises a metallized paper in the form of a paper substrate coated on one surface with a layer of metal, for example aluminium. In one example, the transfer material comprises a metallized plastic film in the form of a polymer substrate coated on one surface with a layer of metal, for example aluminium. In one example, the transfer material comprises a metallized plastic film in the form of a metallized BOPP film, a metallized PET film, or a metallized polyethylene (PE) film.

In some examples, the transfer material is subjected to a corona treatment prior to printing the transparent release composition, which may also improve bond strength or the transparent release composition to the transfer material.

Image Layer

The transparent release composition on the transfer material has printed thereon an image, which may be said to form an image layer. The image layer may comprise a colorant selected from a black colorant, a magenta colorant, a yellow colorant and cyan colorant, or a combination thereof.

In some examples, the image or image layer is printed on the transparent release composition on the transfer material in an electrostatic printing process using an electrostatic ink composition comprising a colorant, a thermoplastic resin and a charge director and/or a charge adjuvant. For example, a liquid electrostatic ink composition comprising a colorant, a thermoplastic resin and a charge director and/or a charge adjuvant dispersed in a carrier liquid. Any suitable colorant can be used, for example a pigment. The thermoplastic resin, charge director, charge adjuvant, carrier liquid and/or additives may be as described above in relation to the transparent release composition. In some examples, the electrostatic ink composition may be a commercially available liquid electrostatic ink, for example CMYK ElectroInks® available from HP Indigo™.

The image or information may be mirror printed onto the transfer material such that the image transferred to the target substrate appears as the image input in a digital printing process. In some examples, the image or information may be printed to the transfer material such that the image when viewed on the transfer material appears as the image input in a digital printing process, for example in cases in which the target substrate is transparent, e.g. glass, and the image is to be viewed through the target substrate.

Heat-Activatable Adhesive Composition

In some examples, the heat activatable adhesive composition comprises a heat-activatable resin. In some examples, the heat activatable adhesive composition comprises an emulsion of the heat-activatable resin. In some examples, the heat-activatable adhesive composition is a water based heat-activatable resin emulsion. In some examples, the heat-activatable adhesive composition is a solvent based heat-activatable resin emulsion. In some examples, the heat activatable adhesive composition comprises a powder of a heat-activatable resin.

In some examples, the heat-activatable resin is a thermoplastic resin. In some examples, the heat-activatable resin is a thermoplastic resin having polar sites. It has been found that thermoplastic resins having polar sites provide improved adhesion to target substrates, particularly to target substrates such as glass and metal.

In some examples, the heat-activatable resin is selected from the group comprising acrylic resins, polyester resins, polyurethane resins, poly vinyl alcohol resins, poly vinyl acetate resins, acrylamide resins, polyamide resins, polyimide resins, epoxy resins and ionomers. In some examples, the heat-activatable resin is selected from the group comprising acrylic resins, polyester resins, polyurethane resins, poly vinyl alcohol resins, poly vinyl acetate resins, acrylamide resins, polyimide resins, and epoxy resins.

In some examples, the heat-activatable resin is a polymer/copolymer derived from a monomers comprising a group selected from acrylics, esters, urethanes, vinyl alcohols, vinyl acetates, acrylamides, amides, and epoxides.

Examples of acrylic resins include polymers/copolymers derived from acrylic acid, methacrylic acid, acrylate, methacrylate monomers (for example alkylene (meth)acrylic acid and alkylene (meth)acrylate such as ethylene acrylic acid, ethylene methacrylic acid, ethylene acrylate and ethylene methacrylate) and ionomers thereof.

Examples of monomers comprising an acrylic group include acrylic acid, methacrylic acid, alkyl acrylates (such as methyl acrylate) and alkyl methacrylates (such as methyl methacrylate).

Examples of polyester resins include polyethylene terephthalate.

Examples of poly vinyl alcohol resins include polyvinyl alcohol (PVOH) modified polyolefins, such as PVOH polypropylene.

Examples of poly vinyl acetate resins include polymers/copolymers derived from vinyl acetates, such as alkylene vinyl acetates (e.g. ethylene vinyl acetate).

Examples of acrylamide resins include polymers/copolymers derived from acrylamide and methacrylamide monomers, such as alkylene acrylamide and alkylene methacrylamides.

In examples in which the heat-activatable adhesive comprises a solvent other than water, the solvent may be selected from the group comprising acetates, xylene, ketones, toluene, alcohols, and naptha, for example ethyl acetate, Xylene, n-propyl acetate, methyl methyl ketone, xylene, toluene, naphta and isopropyl ethanol.

The heat activatable-resin may be a thermoplastic resin that becomes an adhesive at a temperature of about 40° C. or greater, for example about 50° C. or greater, about 60° C. or greater. For example, the heat activatable-resin may be a thermoplastic resin that is softened and/or begins to melt at a temperature of about 40° C. or greater, for example about 50° C. or greater, about 60° C. or greater. In some examples, the heat activatable-resin softens and/or begins to melt at a temperature in the range of about 40° C. to about 150° C., for example about 50° C. to about 150° C., about 60° C. to about 150° C., about 60° C. to about 130° C., about 60° C. to about 120° C., about 60° C. to about 110° C., for example 60° C. to about 90° C.

In some examples, the heat activatable-resin has a softening temperature in the range of 40° C. to about 150° C., for example about 50° C. to about 150° C., about 60° C. to about 150° C., about 60° C. to about 130° C., about 60° C. to about 120° C., about 60° C. to about 110° C., for example 60° C. to about 90° C.

In some examples the softening temperature may be the Ring and Ball softening temperature as determined according to ASTM E28-99, or the Vicat softening temperature as measured according to ASTM D1525.

The heat-activatable adhesive composition may be applied to the image layer using any suitable method, for example gravure coating (e.g. flexo-gravure), direct coating, jetting, or spraying.

In some examples, the heat-activatable adhesive layer or heat-activated release layer has a thickness of about 1 μm or greater, for example about 5 μm or greater, or about 10 μm or greater. In some examples, the heat-activatable adhesive layer or heat-activated release layer has a thickness of about 30 μm or less, for example about 20 μm or less, or about 15 μm or less. The heat-activatable adhesive layer or heat-activated release layer may have a thickness in the range of about 1 to about 30 μm, for example about 5 to about 20 μm, or about 10 μm.

In some examples, the heat-activatable adhesive layer is applied to the image layer to provide a heat-activtable adhesive layer having a dry coat weight (e.g. a heat-activatable resin coat weight) of about 0.5 $g/m^2$ or greater, for example about 1 $g/m^2$ or greater, or about 1.5 $g/m^2$ or greater. In some examples, the heat-activatable adhesive layer is applied to the image layer to provide a heat-activtable adhesive layer having a dry coat weight (e.g. a heat-activatable resin coat weight) of up to about 10 $g/m^2$, for example up top about 5 $g/m^2$, or up to about 4.5 $g/m^2$. In some examples, the heat-activatable adhesive layer is applied to the image layer to provide a heat-activtable adhesive layer having a dry coat weight (e.g. a heat-activatable resin coat weight) in the range of about 1.5 $g/m^2$ to about 4.5 $g/m^2$.

Heat Transfer Printing

The activated adhesive layer, image layer and the transparent release layer are transferred from the transfer material to the target substrate by heat transfer printing. This may involve contacting the heat-activatable adhesive layer on the transfer material with a target substrate under conditions such that the heat-activatable adhesive layer is activated and the release layer is softened (for example becomes molten) and separating the target substrate and the transfer material, to leave the target substrate having thereon the adhesive layer, image layer and overlying transparent release layer. Heat and/or pressure may be applied to effect the activation of the heat-activatable adhesive layer (to become an activated adhesive layer, e.g. by softening/melting the heat-activatable resin of the heat-activatable adhesive composition) and the softening (e.g. melting) of the release layer (e.g. the softening/melting of the thermoplastic resin of the transparent release composition). The contacting may be carried out on a lamination apparatus or a pressure sealer, which are commercially available.

The contacting may be carried out at a suitable temperature to allow the thermoplastic resin of the release layer to soften or become molten during the contacting. The suitable temperature may be a raised temperature, e.g. of 30° C. or above, in some examples 40° C. or above, in some examples 50° C. or above, in some examples 60° C. or above, 70° C. or above, 80° C. or above, in some examples 100° C. or above, in some examples 150° C. or above, in some examples 180° C. or above. The suitable temperature may be from 30° C. to 100° C., in some examples 30° C. to 80° C. in some examples 30° C. to 70° C., in some examples 40° C. to 80° C. The suitable temperature may be from 50° C. to 250° C., in some examples from 60° C. to 220° C., in some examples from 90° C. to 210° C., in some examples from 90 to 130° C., in some examples from 100 to 110° C. The target substrate and the transfer material may be separated while the thermoplastic resin is softened or molten.

The temperature may be a temperature at or above the Vicat softening point of the thermoplastic resin of the release layer, as measured using ASTM D1525. The temperature may be a temperature at or above the freezing point of the thermoplastic resin of the release layer, as measured by Differential Scanning Calorimetry under ASTM D3418. The temperature may be a temperature at or above the melting point of the thermoplastic resin of the release layer, as measured by Differential Scanning calorimetry under ASTM D3418. Where a plurality of polymers are used in the thermoplastic resin, the softening point, freezing point or the melting point, may be measured on the blend of polymers.

The contacting may be carried out at a suitable temperature to allow the heat activatable resin of the heat-activatable layer to soften or become molten during the contacting. The suitable temperature may be a raised temperature, e.g. of 30° C. or above, in some examples 40° C. or above, in some examples 50° C. or above, in some examples 60° C. or above, 70° C. or above, 80° C. or above, in some examples 100° C. or above, in some examples 150° C. or above, in some examples 180° C. or above. The suitable temperature may be from 30° C. to 100° C., in some examples 30° C. to 80° C. in some examples 30° C. to 70° C., in some examples 40° C. to 80° C. The suitable temperature may be from 50° C. to 250° C., in some examples from 60° C. to 220° C., in some examples from 90° C. to 210° C., in some examples from 90 to 130° C., in some examples from 100 to 110° C. The heat-activatable adhesive layer may adhere to the target substrate while the heat-activatable resin is softened or molten.

The temperature may be a temperature at or above the Ring and Ball softening point of the heat-activatable resin of the heat-activatable adhesive layer, as measured using ASTM E28-99. The temperature may be a temperature at or above the freezing point of the heat-activatable resin, as measured by Differential Scanning Calorimetry under ASTM D3418. The temperature may be a temperature at or above the melting point of the heat-activatable resin, as measured by Differential Scanning Calorimetry under ASTM D3418. Where a plurality of polymers are used in the heat-activatable resin, the softening point, freezing point or the melting point, may be measured on the blend of polymers.

The contacting may be carried out at a suitable temperature to allow the thermoplastic resin of the release layer and the heat activatable resin of the heat-activatable layer to soften or become molten during the contacting. The suitable temperature may be a raised temperature, e.g. of 30° C. or above, in some examples 40° C. or above, in some examples 50° C. or above, in some examples 60° C. or above, 70° C. or above, 80° C. or above, in some examples 100° C. or above, in some examples 150° C. or above, in some examples 180° C. or above. The suitable temperature may be from 30° C. to 100° C., in some examples 30° C. to 80° C. in some examples 30° C. to 70° C., in some examples 40° C. to 80° C. The suitable temperature may be from 50° C. to 250° C., in some examples from 60° C. to 220° C., in some examples from 90° C. to 210° C., in some examples from 90 to 130° C., in some examples from 100 to 110° C. The heat-activatable adhesive layer may adhere to the target substrate while the heat-activatable resin is softened or molten and the target substrate and the transfer material may be separated while the thermoplastic resin is softened or molten.

The contacting may involve pressing the transfer material and the target substrate between two members, at least one of which, in some examples both of which, is/are heated, e.g. to a temperature mentioned above. In some examples, the two members may be heated to the same temperature, e.g. to a temperature mentioned above. In some examples, the two members may be heated to different temperatures, e.g. one at a temperature of from 40° C. to 100° C., e.g. 40° C. to 70° C., and the other at a higher temperature, e.g. a temperature of 80° C. or more, e.g. a temperature of from 80° C. to 250° C., e.g. a temperature of from 90° C. to 150° C., or from 100° C. to 150° C. In some examples, at least one of the members is heated to a temperature of 90° C. or above, for example 100° C. or above. The two members may be rollers, and may be part of a lamination apparatus. If the two members are rollers, the speed of passing the target substrate and the transfer material (having the transparent release layer, image layer and heat activatable adhesive layer there between) through the rollers may be a suitable speed to allow the activation of the heat-activatable adhesive layer and the thermoplastic resin of the transparent release layer to soften or melt. The speed may be at least 0.1 m/min, in some examples at least 0.5 m/min, in some examples at least 1 m/min. The speed may be at least 10 m/min or less, in some examples 5 m/min or less, in some examples 4 m/min or less, in some examples 3 m/min or less. The speed may be of from 0.1 m/min to 10 m/min, in some examples from 0.5 m/min to 5 m/min, in some examples 0.5 m/min to 4 m/min, in some examples 1 m/min to 3 m/min. The speed may be determined depending on the temperature of the rollers, with a higher temperature leading to faster activation of the heat-activatable adhesive layer and/or faster softening/melting of the thermoplastic resin, allowing for a higher speed, since the contact time can be less.

Pressure may be applied to the transfer material and the target substrate during the contacting, e.g. at the temperatures mentioned above. The pressure may be a pressure of at least from 1 bar (100 kPa), in some examples at least 2 bar, in some examples from 1 bar to 20 bar, in some examples 2 bar to 10 bar, in some examples 2 bar to 5 bar, in some examples 5 bar to 10 bar.

The contacting under a raised temperature and, in some examples, under pressure, may be carried out for a suitable time period to effect adhesion and to soften the release layer, and the suitable time period may be selected at least 0.1 seconds, in some examples at least 0.2 seconds, in some examples at least 0.5 seconds, in some examples at least 0.8 seconds, in some examples at least 1 second, in some examples at least 1.2 seconds, in some examples at least 1.5 seconds, in some examples at least 1.8 seconds, in some examples at least 2 seconds. The suitable time may be from 0.1 seconds to 10 seconds, in some examples 0.5 seconds to 5 seconds.

Electrostatic Printing

The electrostatic printing of the transparent release composition may comprise forming a latent electrostatic image on a surface;

contacting the surface with the transparent release composition, such that at least some of the transparent release composition adheres to the surface to form a developed toner image on the surface, and transferring the toner image to a print substrate (e.g. the transfer material), in some examples via an intermediate transfer member. The transparent release composition during printing may comprise particles, which may be termed toner particles, the particles comprising the thermoplastic resin, and, in some examples, a charge adjuvant and/or a charge director.

The image layer may be formed by electrostatically printing an electrostatic ink composition comprising a colorant. The image layer may comprise a thermoplastic resin, and a charge adjuvant and/or a charge director. The thermoplastic resin, the charge adjuvant and/or the charge director of the electrostatic ink composition used to form the image may, each, independently, be the same as or different from the thermoplastic resin, the charge adjuvant and/or the charge director of the transparent release composition, and may be selected from the thermoplastic resin, the charge adjuvant and/or the charge director disclosed above in respect of the transparent release composition. The colorant of the electrostatic ink composition used to form the image layer may be selected from a black colorant, a magenta colorant, a cyan colorant and a yellow colorant.

The printing of the image layer may be carried out using an electrostatic printing process, e.g. using the same electrostatic printing apparatus used to print the transparent release composition on the transfer material. The electrostatic printing of the image layer may involve forming a further latent electrostatic image on a surface;

contacting the surface with an electrostatic ink composition comprising a colorant, such that at least some of the electrostatic ink composition comprising a colorant adheres to the surface to form a developed colorant-containing toner image on the surface, and transferring the toner image to the transparent release composition (e.g. release layer) on the transfer material, in some examples via an intermediate transfer member.

In some examples, the transparent release composition and the electrostatic ink composition are liquid electrostatically printed.

The electrostatic printing of the transparent release composition and the overlying image layer on the transfer material may be carried out in a single pass, e.g. by printing the transparent release composition and the image together onto the transfer material, e.g. such that the image layer overlies the transparent release composition on the transfer material. In some examples, this may involve disposing an image layer (formed with an electrostatic ink composition comprising a colorant) first on an intermediate transfer member in an electrostatic printing process and then forming an overlying layer of transparent release composition on the image layer, and transferring the image layer and the transparent release layer to the transfer material.

The surface on which the latent electrostatic image is formed may be on a rotating member, e.g. in the form of a cylinder. The surface on which the latent electrostatic image is formed may form part of a photo imaging plate (PIP). The contacting may involve passing the transparent release composition between a stationary electrode and a rotating member, which may be a member having the surface having a latent electrostatic image thereon or a member in contact with the surface having a latent electrostatic image thereon. A voltage is applied between the stationary electrode and the rotating member, such that the particles adhere to the surface of the rotating member. This may involve subjecting the transparent release composition to an electric field having a field gradient of 50-400 V/μm, or more, in some examples 600-900 V/μm, or more.

The intermediate transfer member may be a rotating flexible member, which is in some examples heated, e.g. to a temperature of from 80 to 160° C., in some examples from 90 to 130° C., in some examples from 100 to 110° C.

EXAMPLES

The following illustrates examples of the methods and other aspects described herein. Thus, these Examples should not be considered as limitations of the present disclosure, but are merely in place to teach how to make examples of the present disclosure.

In the following examples, 'Isopar' is Isopar™ L Fluid, produced by ExxonMobil™ and having CAS Number 64742-48-9.

In the following examples, the thermoplastic resin of the transparent release layer composition contains a combination of Nucrel 699™ (a copolymer of ethylene and methacrylic acid, made with nominally 11 wt. % methacrylic acid, available from DuPont™) and A-C 5120™ (a copolymer of ethylene and acrylic acid with an acid number of 112-130 KOH/g, available from Honeywell™) in a weight ratio of 4:1.

In the following examples, NCD indicates a natural charge director made of three components: KT (natural soya lecithin in phospholipids and fatty acids), BBP (basic barium petronate i.e. a barium sulfonate salt of a 21-26 hydrocarbon alkyl, supplied by Chemtura), and GT (dodecyl benzene sulfonic acid isopropyl amine, supplied by Croda). The composition being 6.6 wt % KT, 9.8 wt % BBP and 3.6 wt % GT, balance 80% Isopar.

In the following examples, maltose monohydrate (available from Fisher™) was provided as the solid polar compound of the transparent release composition.

In the following examples, the electrostatic inks used to provide the image layer were CMYK ElectroInk® 4.5 (available from HP Indigo™).

In the following examples, the transfer material used was a PET (12 micron) substrate obtained from Polypex Corporation. Before electrostatic printing of the release layer, the transfer material was treated with corona (1 kW).

In the following examples, the heat-activatable adhesive composition used was MM FlexP1883 (a water based ethylene acrylic acid dispersion, available from Michelman™)

Example 1

A transparent release composition was prepared by providing 73.14 g of a paste containing 35 wt % of the thermoplastic resin (Nucrel 699™ (DuPont™) and A-C 5120™ (Honeywell™) in the ratio of 4:1 by weight), 35 wt % maltosemonohydrate (Fisher), 1.0 wt % aluminum stearate (grinding aid material/charge adjuvant, available from Sigma Aldrich™) in Isopar™. The paste was ground using a laboratory attritor (S0 from union process USA) at 25° C. for 24 hours. The paste was diluted to 2 wt % solids with Isopar™ and charged by adding 8 ml of commercially available HP Indigo™ Imaging Agent (NCD) and left overnight prior to printing.

A liquid electrostatic printing apparatus (Indigo™ 6700 printing press from Hewlett-Packard™) was used to electrostatically print the transparent release composition to form a release layer (one separation) on the transfer material and subsequently to electrostatically print the electrostatic ink composition on the release layer to provide an image layer disposed on the release layer.

The heat-activatable adhesive composition was then applied to the image layer using a draw down technique (wire rod #4, available from Diversified Enterprises in Claremont, N.H. USA), the heat-activatable adhesive composition was then dried in an oven for 5 min at 60° C. to provide a heat-activatable adhesive layer disposed on the image layer, the heat-activatable adhesive layer having a thickness of 10.2 μm and a dry coat weight of 2.6 g/m$^2$.

Comparative Example 2

A heat transferable printed image was produced according to Example 1, except that no heat-activatable adhesive layer was provided, i.e. the heat transferable printed image consisted of the transfer material, the release layer and the image layer.

Example 3—Heat Transfer Printing

Thermal transfer of the heat transferable printed image of Example 1 to an aluminium target substrate (AI/PE film) was performed using a laboratory laminator (from GMP, model EXCELAM PLUS 355RM). The aluminium side of the AI/PE film (target substrate) was placed on top of the heat-activatable adhesive layer of the heat transferable printed image of Example 1. The heat transferable printed image and target substrate were then passed through two heated rolls of the laboratory laminator at a speed of 1 m/min to thermally transfer the image to the target substrate. The two heated rolls were heated to different temperatures, with the PET transfer material bearing the heat transferable image contacting the top roll having a temperature of 120° C. and the target substrate (AI/PE film) contacting the bottom roll having a temperature of 50° C. The materials, i.e. the transfer material and the target substrate with the release layer, image layer and adhesive layer in between, were then removed from the laminator and allowed to cool to room temperature. After cooling the transfer material was separated from the target film. The image was transferred completely to the target substrate.

Comparative Example 4

Example 3 was repeated, except that the heat transferable image of Comparative Example 2 was used in place of the heat transferrable image of Example 1. The image was transferred to the target substrate.

The durability of the heat transferred images on the target substrates produced according to Example 3 and Comparative Example 4 were tested by scratching the surface of the transferred image with a finger nail and manually applying and removing a piece of adhesive tape (Scotch Magic tape (3M). 810) from the image. After scratching the transferred image of Example 3 with a finger nail, no scratches were visible on the image of Example 3 and the tape did not remove any of the image layer. The transferred image of Comparative Example 4 was easily scratched by a finger nail and the image layer was also removed from the target substrate by the adhesive tape as it was unpeeled.

Example 5

Example 3 was repeated, except that the target substrate was a 1 mm thick glass slide. As for Example 3, the image was transferred completely to the target substrate.

Comparative Example 6

Example 5 was repeated, except that the heat transferable image of Comparative Example 2 was used in place of the heat transferrable image of Example 1. No image was transferred to the glass target substrate.

The present inventors have found that the heat transferrable printed images prepared according to the methods described herein have improved durability as well as improved adhesion to a range of print substrates.

Without wishing to be bound by theory, it is thought that the heat-activatable adhesive composition penetrates into the image layer in order to improve durability of a transferred image as well as providing for improved adhesion.

While the process and related aspects have been described with reference to certain examples, those skilled in the art will appreciate that various modifications, changes, omissions, and substitutions can be made without departing from the spirit of the disclosure. It is intended, therefore, that the process and related aspects be limited by the scope of the following claims. The features of any dependent claim can be combined with the features of any of the other dependent claims, and any independent claim.

The invention claimed is:

1. A process for heat transfer printing, the process comprising:

electrostatically printing a transparent release composition onto a transfer material to form a release layer disposed on the transfer material;

electrostatically printing an electrostatic ink composition to form an image layer disposed on the release layer;

applying a heat-activatable adhesive composition to the image layer to form a heat-activatable adhesive layer;

contacting the heat-activatable adhesive layer with a target substrate under conditions such that the heat-activatable adhesive layer is activated to adhere to the target substrate and the release layer is softened; and separating the target substrate and the transfer material such that the heat-activatable layer, image layer and release layer are transferred to the target substrate.

2. A process according to claim 1, wherein the heat-activatable adhesive composition comprises a heat-activatable resin.

3. A process according to claim 2, wherein the heat-activatable resin is a thermoplastic resin comprising polar sites.

4. A process according to claim 3, wherein the heat-activatable resin is selected from the group comprising acrylic resins, polyester resins, polyurethane resins, poly vinyl alcohol resins, poly vinyl acetate resins, acrylamide resins, polyamide resins, polyimide resins, epoxy resins, and ionomers.

5. A process according to claim 3, wherein the heat-activatable resin has a softening temperature in the range of from about 40° C. to about 150° C.

6. A process according to claim 2, wherein the heat-activatable adhesive composition comprises a water-based emulsion of a heat-activatable resin.

7. A process according to claim 1, wherein the transparent release composition comprises a thermoplastic resin.

8. A process according to claim 7, wherein the thermoplastic resin has a softening temperature in the range of about 40° C. to about 150° C.

9. A process according to claim 7, wherein the transparent release composition further comprises a solid polar compound.

10. A process according to claim 9, wherein the solid polar compound is present in an amount from about 20 to 60 wt % of the total solids of the transparent release composition.

11. A process according to claim 9, wherein the solid polar compound is selected from the group consisting of a saccharide, polyacrylic acid, polyvinyl alcohol, styrene maleic anhydride, a bismaleimide oligomer, a cellulose derivative and an aliphatic urethane acrylate.

12. A process according to claim 1, wherein the target substrate comprises metal or glass.

13. A process according to claim 1, wherein the heat-activatable adhesive layer and target substrate are contacted at a temperature in the range of about 50° C. to about 250° C.

14. A heat transferable printed image comprising:

a transfer material;

an electrostatically printed transparent release layer disposed on the transfer material;

an electrostatically printed image layer disposed on the release layer; and a heat-activatable adhesive layer disposed on the image layer.

15. A method of printing a heat transferable image, the method comprising:

electrostatically printing a transparent release composition onto a transfer material to form a release layer disposed on the transfer material;

electrostatically printing an electrostatic ink composition to form an image layer disposed on the release layer;

applying a heat-activatable adhesive composition to the image layer to form a heat-activatable adhesive layer.

* * * * *